United States Patent [19]

Chevakin et al.

[11] Patent Number: 4,865,391

[45] Date of Patent: Sep. 12, 1989

[54] APPARATUS FOR BUILDING-UP BURSTING FORCES

[76] Inventors: Ivan V. Chevakin, 2 proezd Metallurgov, 2, korpus 2, kv. 5, Tula; Petr A. Radchenko, ulitsa Kharkovskaya, 3, korpus 4, kv. 4, Moscow; Abram I. Pesin, ulitsa Levy Bereg Oki, 57, kv. 20, Orel; Nikolai P. Zharov, ulitsa Michurina, 143, kv. 8, Tula, all of U.S.S.R.

[21] Appl. No.: 208,174

[22] Filed: Jun. 17, 1988

[51] Int. Cl.[4] ..... E21C 37/02

[52] U.S. Cl. ..... 299/23

[58] Field of Search ..... 175/17; 299/20, 21, 299/22, 23

[56] References Cited

FOREIGN PATENT DOCUMENTS

| | | | |
|---|---|---|---|
| 0691564 | 10/1979 | U.S.S.R. . | |
| 1020575 | 5/1983 | U.S.S.R. | 299/22 |
| 1191579 | 11/1985 | U.S.S.R. | 299/23 |
| 1218106 | 3/1986 | U.S.S.R. | 299/23 |

*Primary Examiner*—Jerome W. Massie
*Assistant Examiner*—Terry Lee Melius
*Attorney, Agent, or Firm*—Burgess, Ryan & Wayne

[57] ABSTRACT

An apparatus for building-up bursting forces has a main casing filled with ice and having an outlet port and a variable-volume working chamber having an inlet port for communication with the outlet port of the main casing. There are provided a plurality of auxiliary casings filled with ice and a means for alternately establishing communication between the outlet ports of the main and auxiliary casings and the inlet port of the variable-volume working chamber.

3 Claims, 2 Drawing Sheets

APPARATUS FOR BUILDING-UP BURSTING FORCES

FIELD OF THE INVENTION

The present invention relates to the field of creation of substantial directive forces, and in particular, it relates to an apparatus for building-up bursting forces.

The invention may be most successfully used inthe mining for:

non-explosion tunneling in rocks, e.g. in the construction of tunnels;

working natural stone quarries by breaking along a borehole line large-size monoliths from a rock mass with subsequent cutting thereof into blocks;

preventing sudden gas outbursts by carrying out positive bed relief;

fracturing of formations in oil and gas wells during construction;

destruction of cast-in-place concrete and reinforced concrete structures where it is not possible to employ explosives;

breaking down hard-to-break mining roofs.

BACKGROUND OF THE INVENTION

Known in the art is an apparatus for building-up bursting forces (SU, A, 691564), comprising a hollow body filled with ice and having an outlet port and a variable-volume working chamber having an inlet port for establishing communication with the outlet port of the hollow body.

The hollow body is in the form of a cylinder closed at the ends thereof, the cross-sectional area of the cylinder being larger than the cross-sectional area of the oulet port in one end of the cylinder. A pouring port having a shut-off valve is provided in the opposite end of the cylinder.

The variable-volume working chamber is in the form of a perforated pipe having an inlet port in one end wall thereof, directly connected to the outlet port of the hollow body, the other end wall having a passage with a valve for establishing communication of the interior of the pipe with atmosphere and the peripheral wall having radial ports communicating with grooves made in the outer periphery of the pipe for receiving wedge-shaped elastic radially movable members which are moved radially outwardly under the action of ice pressure in the body and working chamber upon a change in temperature of the preliminarily frozen ice.

The prior art apparatus for building-up bursting forces produces comparatively low energy output so that its employment is rather inefficient.

SUMMARY OF THE INVENTION

It is an object of the invention to provide an apparatus for building-up bursting forces which is so constructed as to improve efficiency of its application.

This object is accomplished by that an apparatus for building-up bursting forces, comprising a main casing filled with ice and having an outlet port and a variable-volume working chamber having an inlet port for communication with the outlet port of the main casing, according to the invention, is provided with a plurality of auxiliary casings filled with ice and with a means for alternately establishing communication between the outlet ports of the main and auxiliary casings filled with ice and the inlet port of the variablevolume working chamber.

The provision of a plurality of auxiliary casings filled with ice and means for alternately communicating their outlet ports with the inlet port of the variable-volume working chamber makes it possible to increase the amount of energy used for building-up bursting forces and to improve efficiency of application of the apparatus.

The means of alternately establishing communication between the outlet ports of the main and auxiliary casings filled with ice and the inlet port of the variable-volume chamber is preferably made in the form of a plate which is rotatable about its axis extending in parallel with the axis of the inlet port of the variablevolume working chamber, the plate having through passages having their axes extending in parallel with the axis of the inlet port of the variable-volume working chamber and being spaced from the axis of rotation of the plate at a distance which is equal to the distance from this axis to the axis of the inlet port of the variable-volume working chamber, one side of the plate facing towards the inlet port of the variable-volume working chamber and the main and auxiliary casings being secured to the opposite side of the plate in such a manner that the outlet ports of the main and auxiliary casings are in registry with the through passages of the plate.

This arrangement greatly simplifies the implementation of the apparatus for building-up bursting forces.

There is preferably provided a second variablevolume working chamber which is similar to said variable-volume working chamber and which is positioned symmetrically therewith with respect to the axis of rotation of the plate, the main and auxiliary casings filled with ice being positioned pairwise symmetrically with respect to said axis of rotation of the plate.

This facility makes it possible to balance forces acting upon the apparatus for building-up bursting forces during operation of the apparatus which greatly improves operability of the apparatus.

Therefore, the apparatus for building-up bursting forces according to the invention is highly efficient; it is rather simple and easy in operation.

These and other advantages of the invention will become apparent from the following detailed description of a specific embodiment with reference to the accompanying drawings.

DETAILED DESCRIPTION OF THE INVENTION

An apparatus for building-up bursting forces according to the invention will be referred to hereinbelow as an apparatus according to the invention.

The apparatus according to the present invention comprises a main casing 1 (FIG. 1) filled with ice and a plurality of auxiliary casings 2, 3, 4, 5, 6, 7, 8 (FIGS. 1 and 2) filled with ice, a variable-volume working chamber 9 (FIG. 1) and a second variable-volume working chamber 10 which is similar to the first one.

Figure 3:
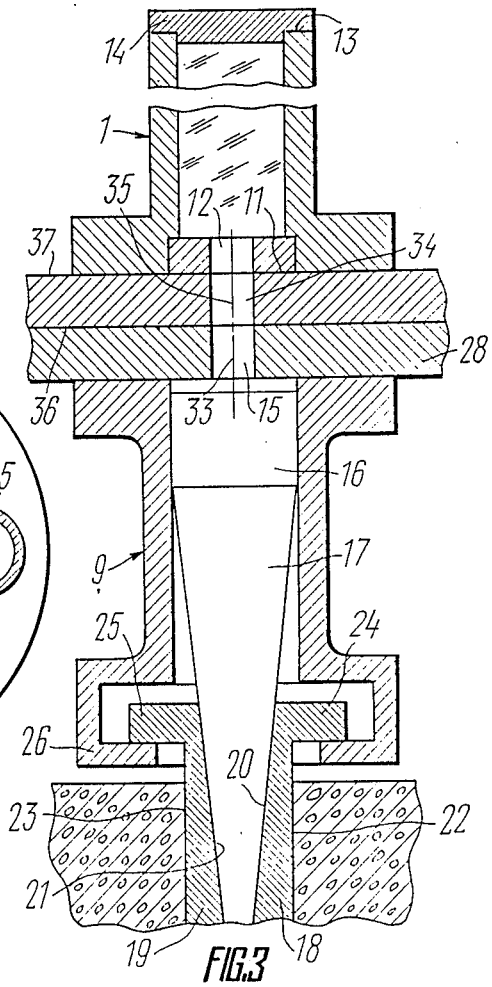
FIG. 3 is an enlarged sectional view taken along line III—III in FIG. 1, partially in section.

Each casing 1, 2, 3, 4, 5, 6, 7, 8 filled with ice is in the form of a hollow cylinder closed at the ends thereof and shown at the same reference numeral. In one end wall of each casing 1 through 8, which is the bottom end wall in FIG. 3, there is provided an outlet port 12. The other end 13, which is the top end in FIG. 3, of each casing 1 through 8 is sealed by a cover plate 14. Each working chamber 9, 10 has an inlet port 15 for communication with the outlet port 12 of a respective casing 1 through 8 and is in the form of a cylinder shown at the same reference numeral. A piston 16 (FIG. 3) connected to a wedge 17 is installed in each working chmber 9, 10. Thrust members 18, 19 (FIG. 3) are positioned adjacent to the wedge 17 and have inner wedge-shaped faces 20, 21, outer cylindrical surfaces 22, 23 and flanges 24, 25 having their lower faces engaging flanges 26, 27 of the working chambers 9, 10. The working chambers 9, 10 which are parallel with each other are secured to a fixed plate 28 having a support column 29.

The apparatus according to the invention has a means 30 (FIG. 1) for alternately establishing communication between the outlet ports 12 of the casings 1 through 4 filled with ice and the inlet port 15 of the working chamber 9 and between the outlet ports 12 of the casings 5 through 8 filled with ice and the inlet port 15 of the working chamber 10.

The means 30 comprising a plate 31 is mounted on the fixed plate 28 for rotation about its axis 32 extending in parallel with an axis 33 (FIG. 3) of the inlet port 15 of the variable-volume working chamber 9, 10.

The plate 31 has through passages 34, having their axes 35 extending in parallel with the axis 33 of the inlet port 15 of the working chamber 9, 10, the passages being spaced from the axis 32 of rotation of the plate 31 at a distance equal to the distance between the axes 32 and 33.

One side 36 of the plate 31 faces towards the inlet ports 15 of the variable-volume working chambers 9, 10 and is adjacent thereto. The casings 1 through 8 are secured to the opposite side 37 of the plate 31 in such a manner that the outlet ports 12 of all the casings 1 through 8 are in registry with the through passages 34 of the plate 30.

Figure 1:
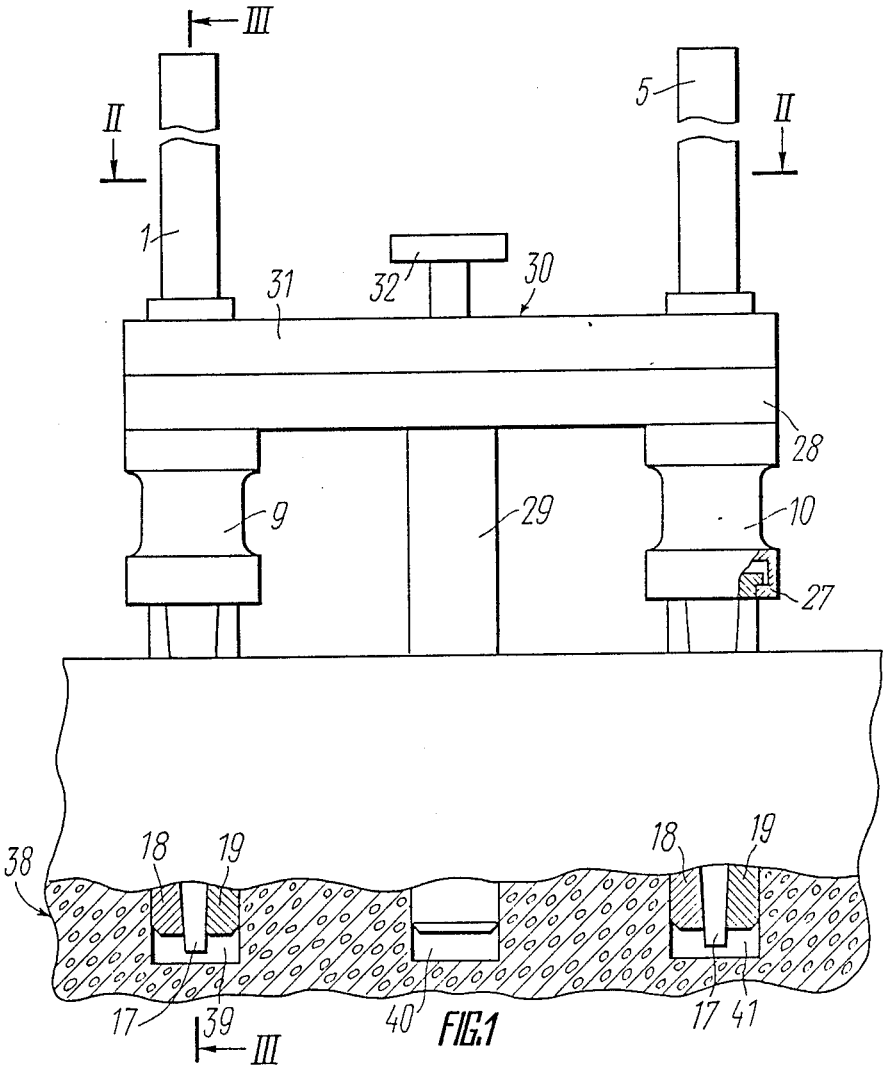
FIG. 1 schematically shows a side elevation view, partially in section, of an apparatus for building-up bursting forces according to the invention.
Figure 2:
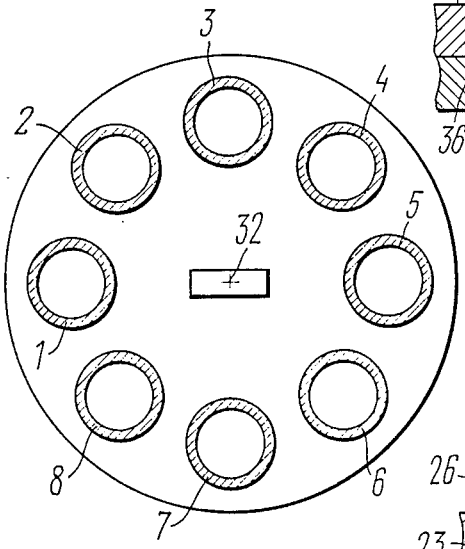
FIG. 2 is ditto showing a diminished sectional view taken along line II—II in FIG. 1.

The working chambers 9, 10 are positioned symmetrically with respect to the axis 32 of rotation of the plate 31 (FIG. 1). The casings 1 and 5, 2 and 6,3 and 7, 4 and 8 are pairwise symmetical with respect to the axis 32 (FIG. 2).

OPERATION

The apparatus according to the invention is used in the following manner.

Boreholes 39, 40, 41 are drilled in a monolith 38 of rock, concrete or reinforced concrete (FIG. 1).

The support column 29 carrying the fixed plate 28 with the rotatable plate 31 removed is inserted into the borehole 40 so that the thrust members 18, 19 of the working chambers 9, 10 are received in the boreholes 39, 41. The pistons 16 having the wedges 17 are moved down in the working chambers 9, 10 until the thrust members 18, 19 bear against the walls of the boreholes 39, 41. The working chambers 9, 10 are filled-up with water through the inlet ports 15, and the water is frozen by any appropriate known method, e.g. with a refrigerant such as carbon dioxide ($CO_2$) to a temperature below −25° C. so that ice at this temperature is formed in the chambers.

When the plate 31 is turned upside down, the casings 1 through 8 are filled with water through the passages 34 and ports 12 facing upwards. The water in the casings 1 through 8 and in the passages 34 is also frozen by any appropriate known means to a temperature below −25° C. with an anticipation of freezing in the passage 34 and is heat insulated.

The plate 31 carrying the casings 1 through 8 is then placed on the fixed plate 28 in the position shown in FIG. 1, and the passages 34, which communicate with the outlet ports 12 of a pair of casings, e.g. casings 1 and 5, are brought in registry with the inlet ports 15 of the working chambers 9, 10.

Subsequently ice is heated by any appropriate known means, in the casings 1 and 5 and, with an anticipation in the working chambers 9, 10, e.g. by providing a natural heat influx by removing the heat insulation, to a temperature of −14° C. and above at which the ice increases in volume and becomes fluid.

As a result of an increase in the ice volume pressure in the ice increases. Under the action of the ice pressure in the working chambers 9, 10 the pistons 16 with the wedges 17 move down to move apart the thrust members 18, 19 which build-up bursting forces acting upon the walls of the boreholes 39, 40.

After the displacement of the pistons 16 in the working chambers 9, 10 under the action of pressure of the ice displaced from the casings 1 and 5, the plate 31 is turned to a position in which the inlet ports 15 of the working chambers 9, 10 are in registry with the passges 34 communicating with the outlet ports 12 of the next pair of casings 2 and 6, and the heating process is repeated with these casings.

Under the action of pressure of the ice displaced from the casings 2 and 6, the pistons 16 will be moved further in the working chambers 9, 10.

Rotation of the plate 31 to bring the inlet ports 15 of the working chambers 9, 10 in registry with the passages 34 communicating with the outlet ports 12 of the next pairs of casings 3, 7 and 4, 8 and heating of these casings are repeated until complete breakage of the monolith 38.

A pilot sample of the apparatus for building-up bursting forces according to the invention was comprehensively tested, and the tests confirmed high efficacy of the apparatus in use.

We claim:

1. An apparatus for building-up bursting forces in a solid, comprising:

a main casing having an outlet port, and said main casing and outlet port being filled with ice, said main casing having a variable-volume working chamber having an inlet port for communication with said outlet port of said main casing;

a plurality of auxiliary casings filled with ice, each said auxiliary casing having an outlet port;

means mounted on said solid for alternately establishing communication between said outlet ports of said main and auxiliary casings and said inlet port of said variable-volume working chamber.

2. An apparatus according to claim 1, wherein said means comprises a plate mounted for rotation about its axis extending in parallel with the axis of said inlet port of said variable-volume working chamber, the plate having through passages having their axes extending in parallel with the axis of said inlet port of said variable-volume working chamber and being spaced form the axis of rotation of the plate at a distance equal to the distance from the axis of rotation of the plate to the axis of said inlet port of said variable-volume working chamber, one side of the plate facing towards said inlet port of said variable-volume working chamber and being adjacent thereto, and said main casing and said auxiliary casings being secured to the opposite side of the plate in such a manner that said outlet port of said main casing and said outlets ports of said auxiliary casings are in registry with the through passages of the plate.

3. An apparatus according to claim 2, wherein there is provided a second variable-volume working chamber which is similar to said variable-volume working chamber and which is positioned symmetrically therewith with respect to the axis of rotation of the plate, said main and auxiliary casings being positioned pairwise symmetrically therewith with respect to the axis of rotation of the plate.

* * * * *